US009408775B2

(12) United States Patent
Hofmann

(10) Patent No.: US 9,408,775 B2
(45) Date of Patent: Aug. 9, 2016

(54) SLIMMING APPARATUS

(71) Applicant: Airpressure Bodyforming GmbH, Berchtesgaden (DE)

(72) Inventor: Werner Hofmann, Salzburg (AT)

(73) Assignee: Airpressure Bodyforming GmbH, Berchtesgaden (DE)

( * ) Notice: Subject to any disclaimer, the term of this patent is extended or adjusted under 35 U.S.C. 154(b) by 814 days.

(21) Appl. No.: 13/676,564

(22) Filed: Nov. 14, 2012

(65) Prior Publication Data

US 2013/0226043 A1 Aug. 29, 2013

Related U.S. Application Data

(63) Continuation-in-part of application No. 12/672,019, filed as application No. PCT/AT2007/000247 on May 24, 2007, now abandoned.

(30) Foreign Application Priority Data

Jun. 1, 2006 (AT) ..... A 955/2006

(51) Int. Cl.
*A61H 9/00* (2006.01)
*A61H 99/00* (2006.01)

(52) U.S. Cl.
CPC ..... *A61H 99/00* (2013.01); *A61H 9/0078* (2013.01); *A61H 2201/0107* (2013.01); *A61H 2205/083* (2013.01)

(58) Field of Classification Search
CPC ..... A61H 99/00; A61H 9/0078; A61H 2201/0107; A61H 2205/083; A61H 9/005; A61H 2201/0157; A61H 2201/1238; A61H 2205/06
USPC ..... 601/148–151
See application file for complete search history.

(56) References Cited

U.S. PATENT DOCUMENTS

| | | | | |
|---|---|---|---|---|
| 4,029,087 | A * | 6/1977 | Dye et al. | 601/152 |
| 5,109,832 | A * | 5/1992 | Proctor et al. | 601/149 |
| 5,496,262 | A * | 3/1996 | Johnson et al. | 601/152 |
| 7,189,193 | B2 | 3/2007 | Egger | |
| 7,384,379 | B2 | 6/2008 | Egger | |
| 2001/0018564 | A1 * | 8/2001 | Manor et al. | 601/152 |
| 2003/0032904 | A1 | 2/2003 | Egger | |

(Continued)

FOREIGN PATENT DOCUMENTS

| | | |
|---|---|---|
| EP | 1 248 586 B1 | 3/2004 |
| EP | 1 307 168 B1 | 4/2005 |
| WO | 01/52787 A2 | 7/2001 |

(Continued)

*Primary Examiner* — Quang D Thanh
(74) *Attorney, Agent, or Firm* — Laurence A. Greenberg; Werner H. Stemer; Ralph E. Locher

(57) ABSTRACT

A slimming device operates by improving cutaneous circulation during activity in the fat burning pulse range carried out on endurance training equipment. The device includes a main body with a fastening element in the form of a sleeve which has at least two chambers that are independent of one another and that can be supplied with a fluid independently of one another. The device can be applied to different body parts and has a belt which is designed with at least two separate chambers, at least one pump for producing the alternating pressure load and a fastening sleeve which press the main body onto the human body in order to start the operation of the pressure chamber.

6 Claims, 5 Drawing Sheets

(56) References Cited

U.S. PATENT DOCUMENTS

| | | | |
|---|---|---|---|
| 2005/0107725 | A1 | 5/2005 | Wild et al. |
| 2005/0187500 | A1 | 8/2005 | Perry et al. |

FOREIGN PATENT DOCUMENTS

| | | | |
|---|---|---|---|
| WO | 03/030808 | A1 | 4/2003 |
| WO | 2004/084790 | A1 | 10/2004 |

* cited by examiner

SLIMMING APPARATUS

CROSS-REFERENCE TO RELATED APPLICATION

This application is a continuation-in-part of copending patent application Ser. No. 12/672,019, filed Feb. 3, 2010; which was a continuation application, under 35U.S.C. §120, of International application PCT/AT2007/000247, filed May 24, 2007; the application also claims the priority, under 35 U.S.C. §119, of Austrian patent application No. AT A955/2006, filed Jun. 1, 2006; the prior applications are herewith incorporated by reference in their entirety.

BACKGROUND OF THE INVENTION

1. Field of the Invention

The invention relates to a slimming apparatus configured to improve cutaneous circulation in a body part of a person.

2. Description of the Related Art

A slimming apparatus of the above-mentioned type is known from European patent publication EP 1 248 586 B1. The slimming apparatus described therein is designed in the form of a garment and comprises a sleeve which at least partially encloses a human body in an airtight manner. The space in between the human body and the sleeve can be pressurized with air to stimulate the cutaneous circulation in that body part.

European patent publication EP 1 307 168 B1 equally discloses a slimming device of the above-mentioned type. The slimming device comprises a housing forming a pressure chamber, wherein a bicycle ergometer is arranged being operable by the legs of a person. The lower part of the body of the person including its legs are arranged within that housing and sealed off from the remaining parts of the body in an airtight manner. A pump is provided to the apparatus which is capable of generating a vacuum inside said housing.

Another apparatus of the above-mentioned type is known from the international patent application publication WO 03/030808 A1. The device is configured in the form of a piece of clothing and comprises several air chambers which can be provided with overpressure and underpressure in an alternating fashion. The air chambers are connected to a pump via separate lines. A similar device is known from international patent application publication WO 01/52787 A1.

From the field of compression therapy, another device used for the treatment of venous leg ulcers is known from the international patent application publication WO 2004/084790 A1. The device described therein is configured to be used for the limb of a mobile patient. The device comprises an inflatable sleeve adapted to surround the limb, a conduit attached to the sleeve for delivering fluid to the sleeve and a portable, wearable controller attached to the conduit that generates and controls the flow of fluid in the device.

In the field of vascular therapy, a compression treatment system is known from United States patent application publication 2005/0187500 A1. The compression treatment system includes a first bladder supported about a limb. The compression treatment system further comprises a second bladder also supported about the limb. The bladders are in fluid communication with a fluid source and the bladders are inflated such that the first bladder is inflated for a first time period and the second bladder is inflated for a second time period.

SUMMARY OF THE INVENTION

The object of the invention is to provide an improved slimming apparatus of the above-mentioned type. A further object of the invention is to provide a slimming apparatus which is characterized by a simple and cost-efficient design.

A further object of the invention is to provide a slimming apparatus able to maximize the fat burning in a particular body part.

A further object of the invention is to provide a slimming apparatus having an improved efficiency.

A further object of the invention is to provide a slimming apparatus which is easily cleanable.

A further object of the invention is to provide a slimming apparatus having an improved usability.

A further object of the invention is to provide a slimming apparatus which can be stored in a space saving manner and which has a reduced weight.

A further object of the invention is to provide a slimming apparatus which is mobile.

A further object of the invention is to provide a slimming apparatus not needing any maintenance.

A further object of the invention is to provide a slimming apparatus which can be sold at a low price to the end consumer directly and which is usable at home, outdoors and on travel.

A further object of the invention is to provide a slimming apparatus, wherein the same pump is usable for different embodiments of the slimming apparatus.

With the foregoing and other objects in view there is provided, in accordance with the invention, a slimming apparatus configured to improve cutaneous circulation in a body part of a person, the person maintaining a pulse in a fat burning pulse range, and the apparatus thereby concentrating the fat burning in said body part, the apparatus comprising:

a. a main body including a fastening element configured to fasten the main body to the body part;
b. a first chamber having a first nozzle;
c. a second chamber having a second nozzle; and
d. a pumping device configured to pressurize and/or depressurize the first chamber and the second chamber;
e. said pumping device including a first tube having a first connecter detachably connected to said first nozzle of said first chamber and a second tube having a second connecter detachably connected to said second nozzle of said second chamber.

In other words, the slimming apparatus according to the invention is configured to improve cutaneous circulation in a body part of a person, the person maintaining its pulse in the fat burning pulse range, the apparatus thereby concentrating the fat burning in said body part. The slimming apparatus comprises a main body comprising a fastening element configured to fasten the main body to the body part. The slimming apparatus further comprises a first chamber having a first nozzle, a second chamber having a second nozzle and a pumping device configured to pressurize and/or depressurize the first chamber and the second chamber. The pumping device comprises a first tube having a first connecter and a second tube having a second connecter. The first connecter is detachably connected to the first nozzle and the second connecter is detachably connected to the second nozzle.

In a further aspect of the invention, the first connecter comprises a releasing element configured to release the connection between the first nozzle and a first connecter when displaced along a first releasing direction and the second connecter comprises second releasing element configured to release the connection between the second nozzle and the second connecter when displaced along a second releasing direction.

In a further aspect of the present invention, the first releasing element and the second releasing element are substantially of annular shape.

In a further aspect of the present invention, the first nozzle comprises a first engaging direction and the second nozzle comprises a second engaging direction, the first releasing direction running substantially opposite to the first engaging direction and the second releasing direction running substantially opposite to the second engaging direction.

In a further aspect of the slimming apparatus, the first nozzle comprises a first closing means and a second nozzle comprises a second closing means, the first closing means being configured to obturate (i.e., close off, flow shut-off) the first nozzle when the first connecter is detached from the first nozzle and the second closing means being configured to obturate the second nozzle when the second connecter is detached from the second nozzle.

In a further aspect of the present invention, the main body is configured as a trouser belt, a waist belt, a kidney belt, a thigh cuff or as sweat slacks.

In yet a further aspect of the slimming apparatus, the pumping device comprises a pump, a first valve configured to open and/or obturate a first duct between the pump and the first tube and a second valve configured to open and/or obturate a second duct between the pump and the second tube.

The invention is further related to a method for controlling a pumping device for a slimming apparatus. The pumping device comprises a pump, a first tube, a second tube, a first duct connecting the pump to the first tube, a second duct connecting the pump to the second tube, a first valve configured to open/or obturate the second duct. The method comprises a) opening the first duct by actuating the first valve;

b) actuating the pump while the first duct is open;

c) ceasing to actuate the pump;

d) opening the second duct by actuating the second valve;

e) obturating the first duct by actuating the first valve;

f) actuating the pump while the second duct is open;

g) obturating the second duct by actuating the second valve;

h) ceasing to actuate the pump i) obturating the second duct by actuating the second valve.

In a further aspect of the method, the pump is actuated for 2 to 10 seconds, preferably approximately 5 seconds, within steps b) and/or f).

In yet a further aspect of the method, the first duct is obturated for 6 to 30 seconds, preferably approximately 15 seconds, within step c).

In accordance with yet another embodiment, the method comprises evacuating a fluid remaining within the first chamber into the environment between steps e) and h). Preferably, the fluid is evacuated into the environment between steps e) and g).

In accordance with yet again another embodiment, the method comprises evacuating a fluid remaining within the second chamber into the environment between steps i) and d). Preferably, the fluid is evacuated into the environment between steps i) and c).

The invention also provides a method for improving cutaneous circulation in a body part of a person by means of a slimming apparatus fastened to said body part, said person maintaining its pulse in the fat burning pulse range, the method thereby concentrating the fat burning in said body part. The slimming apparatus comprising a first chamber and a second chamber. The method for improving cutaneous circulation comprising a) pressurizing the first chamber;

b) maintaining the pressure in the first chamber;

c) depressurizing the first chamber;

d) pressurizing the second chamber;

e) maintaining the pressure in the second chamber;

f) depressurizing the second chamber.

In a further aspect of the method, the first chamber and/or the second chamber are pressurized to a pressure between 0.3 and 0.6, preferably approximately 0.5 bar, within steps a) and/or d).

In another aspect of the method, depressurizing the first chamber is achieved by at least partially evacuating a fluid present in the first chamber into the second chamber. In the alternative, depressurizing the second chamber is achieved by at least partially evacuating a fluid present in the second chamber into the first chamber.

In yet a further aspect of the method, the first chamber and/or the second chamber are pressurized during 2 to 10 seconds, preferably approximately 5 seconds, within steps a) and/or d).

In yet a further aspect of the method, the pressure in the first chamber and/or the second chamber is maintained during 6 to 30 seconds, preferably approximately 15 seconds, within steps b) and/or e).

The objects and features of the present disclosure are set forth with particularity in the appended claims. The present disclosure together with further objectives and advantages may be best understood by reference to the following description, taken in connection with the accompanying drawings, which are described below.

Other features which are considered as characteristic for the invention are set forth in the appended claims.

Although the invention is illustrated and described herein as embodied in a slimming apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
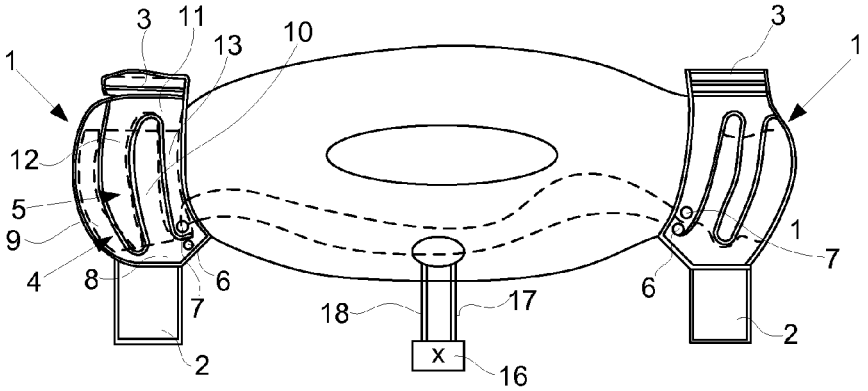
FIG. 1 shows a first embodiment of the invention in a schematic view.

Referring now to the figures of the drawing in detail and first, particularly, to FIG. 1 thereof, there is shown an embodiment that is configured for the treatment of the upper arms of a person. It consists of a main body 1 on which a cuff 2 is formed. A strap 3 is formed on the side of the cuff showing away from the person as a Velcro fastener. The strap 3 can be connected to the Velcro fastener arranged on the main body.

The apparatus comprises a first chamber 4 and a second chamber 5 which can each be supplied with compressed air or another viscous fluid via the feed openings 6, 7. The first chamber 4 consists of a first main section 8 and two branch sections 9, 10 which are separated by broken lines for illustration in FIG. 1. Equally, the second chamber 5 consists of a second main section 11 and two branch sections 12, 13 which are also separated from one another by a broken line in the illustration. As a result of the large flow connection between the main sections 8, 11 and the branch sections 9, 10; 12, 13, the chambers 4, 5 can be supplied rapidly with compressed air or any other medium and can also be discharged rapidly again. High frequencies in the alternating supplying and discharging of the chambers 4, 5 can thus be achieved. In a preferred embodiment, the first chamber 4 and/or the second chamber 5 can be pressurized during 2 to 10 seconds, preferably approximately 5 seconds.

In the embodiment of FIG. 1, the main sections 8; 11 of the chambers 4, 5 are substantially arranged in parallel to the axis of the upper arm during the use and the branch of sections 9, 10; 12, 13 extend substantially in the circumferential direction. The supply of the apparatus via lines 17, 18 by a pump 16 that can be loaded in an alternating manner is shown schematically, which lines open into the first and second chamber 4, 5. The lines 17, 18 each comprise a connecter 25, through which the lines 17, 18 are each detachably connected to a nozzle 26 corresponding to one of the chambers 4, 5. As shown in FIGS. 4*a*, 4*b*, 4*c* and 4*d*, the nozzle 26 comprises closing means configured to obturate the nozzle 26 when the connecter 25 is detached from the nozzle 26, thereby closing the corresponding chamber 4, 5 in an airtight manner. The nozzle 26 comprises a first element 27 and a second element 30, the first element 27 comprising a releasing element 28.

Figure 5A:
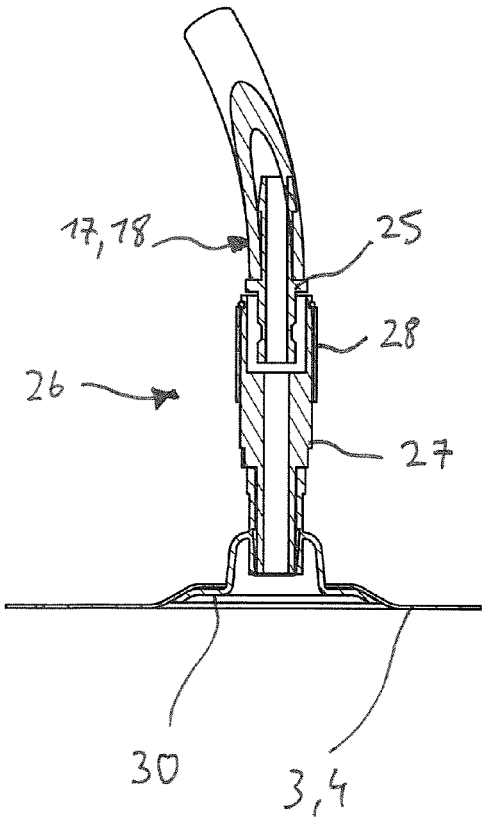
FIG. 5*a* shows an exploded view of an connector engaged by the nozzle.
Figure 5B:
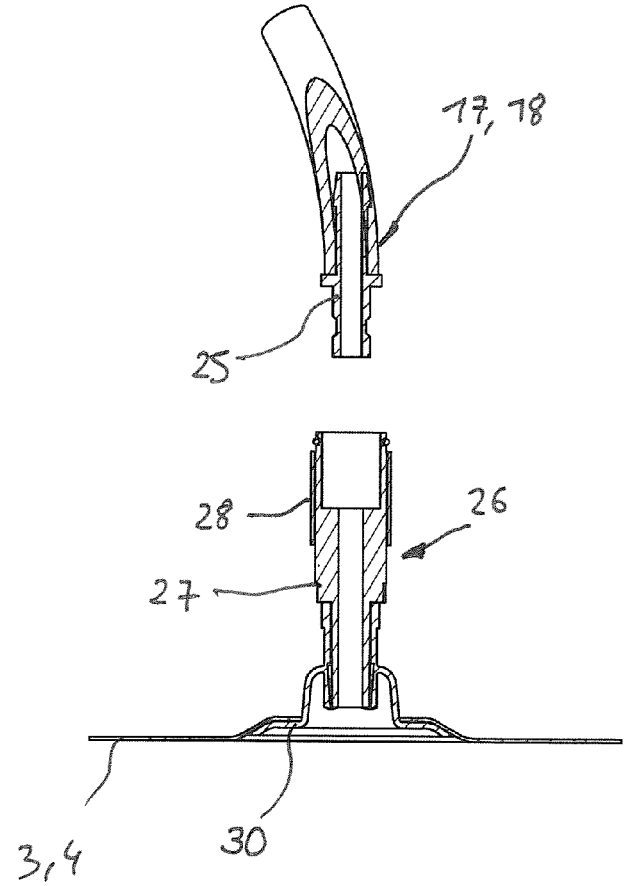
FIG. 5*b* shows an exploded view of the connector released by the nozzle.

As shown in FIG. 5*a*, the connecter 25 is engaged by the nozzle 26, whereby the releasing element 28 is held in a first position. As shown in FIG. 5*b*, the connecter 25 can be detached from the nozzle 26 by actuating the releasing element 28, thereby displacing the releasing element 28 along its longitudinal axis. Preferably, the releasing element 28 is configured as an annular element, which can be pulled away from the connecter 25 to detach the connecter 25 from the nozzle 26.

As further disclosed in the FIGS. 4*a*, 4*b*, 4*c* and 4*d*, the nozzle 26 is attached to the chamber 4, 5 by connecting a first element 27 and a second element 30 through an opening 32 in the cladding of the chamber 4, 5 from both sides of the cladding, the second element 30 being arranged within the chamber 4, 5 and the first element 27 being arranged outside of the chamber 4, 5.

Figure 4A:
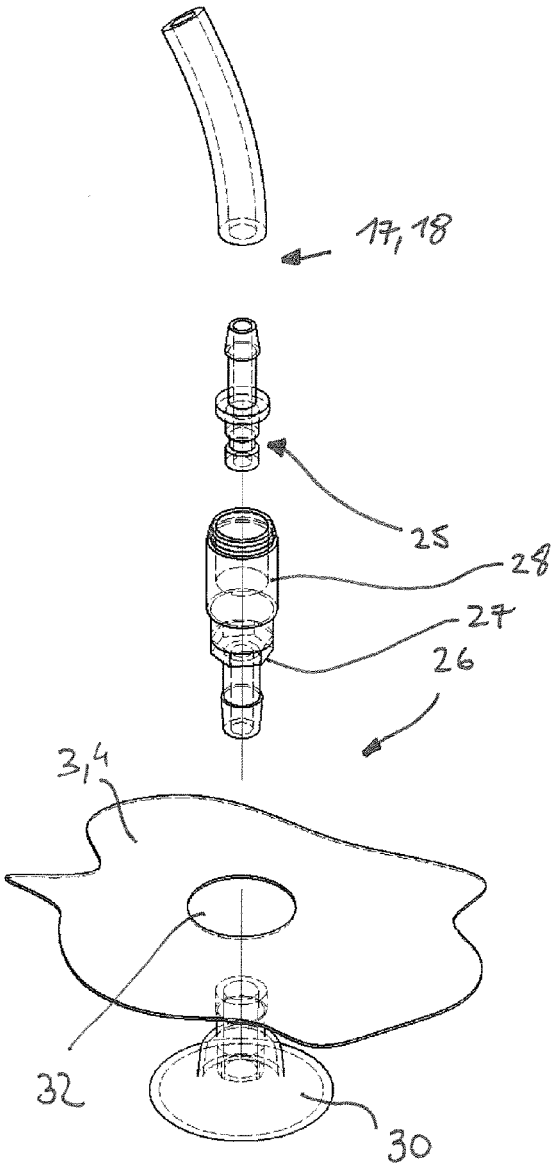
FIG. 4*a*-4*d* show exploded views of the connection between a nozzle and a chamber of the inventive apparatus.
Figure 4B:
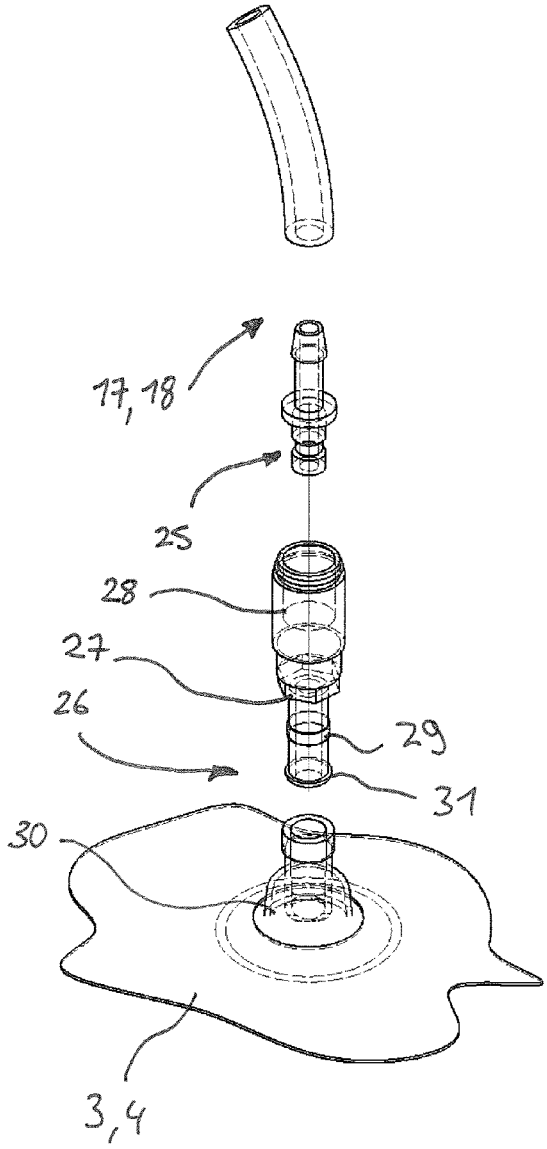
Figure 4C:
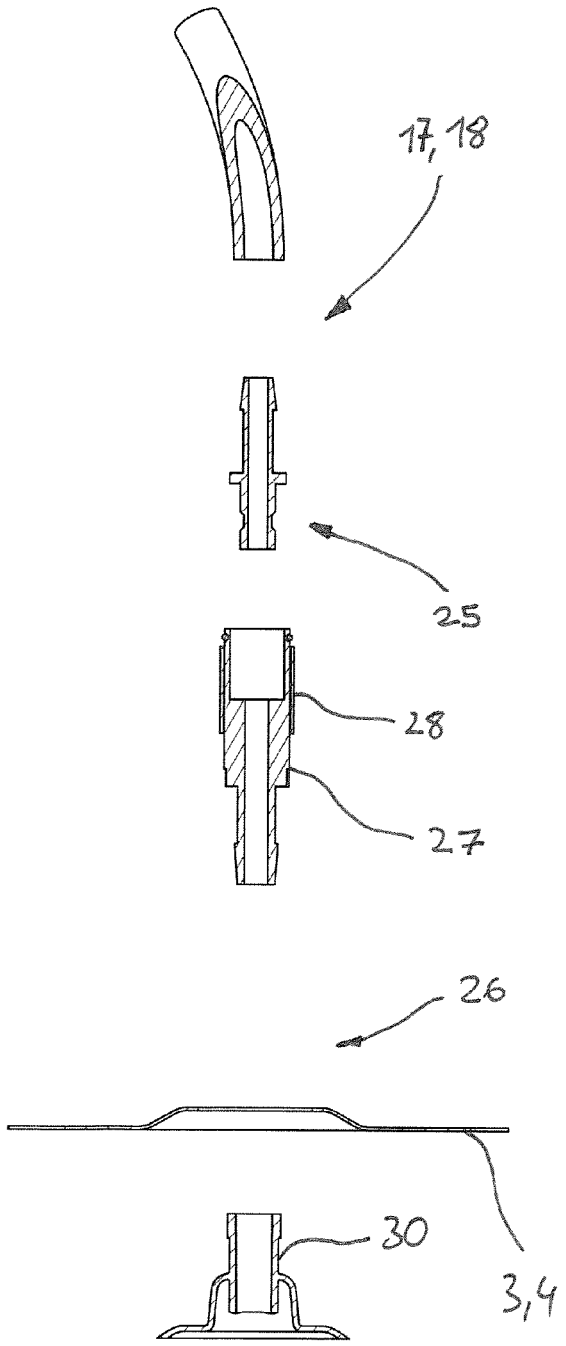
Figure 4D:
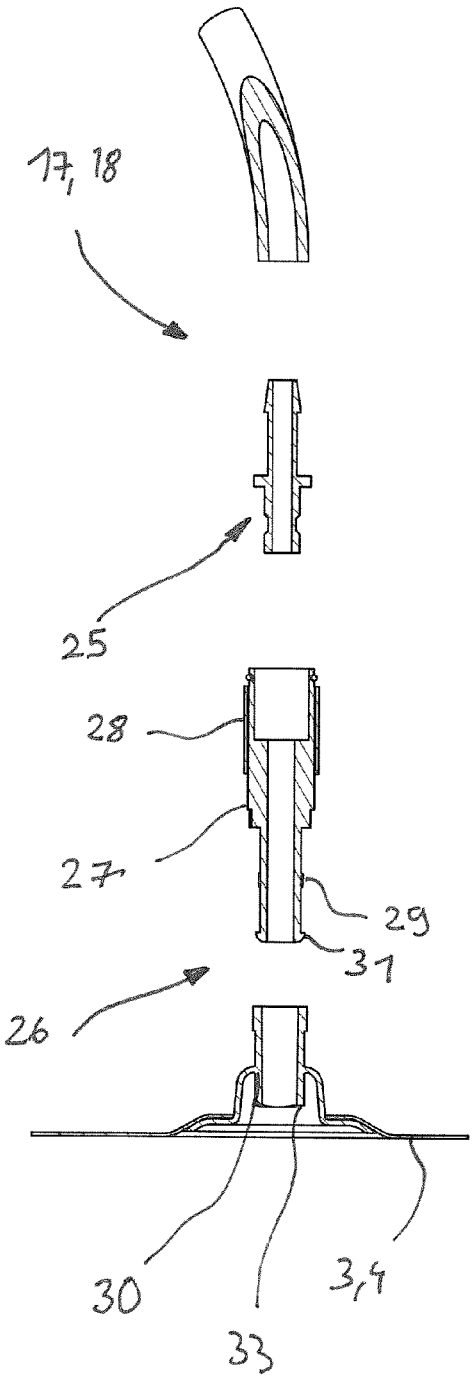

In the embodiment disclosed in the FIGS. 4*b* and 4*d*, the first element 27 comprises a sealing element 29, which is preferably of annular shape and which is interposed between the first element 27 and the second element 30. In this embodiment, the first element 27 further comprises a projection 31, which extends in a radial direction and which is engaged to a surface 33 when the first element 27 is connected to the second element 30

In order to enable the correct positioning and fastening of the two cuffs 2 on the body, a shoulder part (like a pullover) made of neoprene is sewed in between. The connecting tubes are joined with connection elements on two valve outputs in the chest part.

Figure 2:
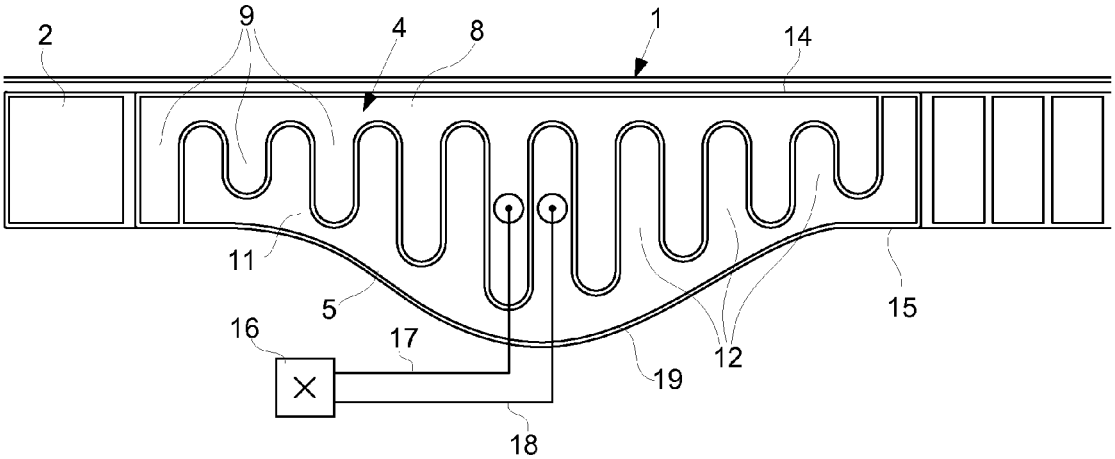
FIG. 2 shows a second embodiment of the invention in a schematic view.

FIG. 2 shows an alternative embodiment of the invention which can also be used as an apparatus for the stomach area. For reasons of simplicity, merely the main body 1 is shown. The fastening can occur as shown in FIG. 1 or a Velcro fastener 2 can be provided. In this embodiment, the main sections 8; 11 of the chambers 4, 5 are arranged along the circumferential edges 14, 15 of the main body 1. The branch sections 9; 12 are arranged in a rectangular manner in relation to the main sections 8; 11 and extend substantially in parallel to the axis of the respective body part. The illustration schematically shows the supply of the apparatus by a pump 16 by which the chambers 4, 5 can be pressurized and/or depressurized via tubes 17, 18. FIG. 2 further shows that the circumferential edges need not necessarily be arranged in a straight line, but can also have convex sections 19 for instance.

Figure 3:
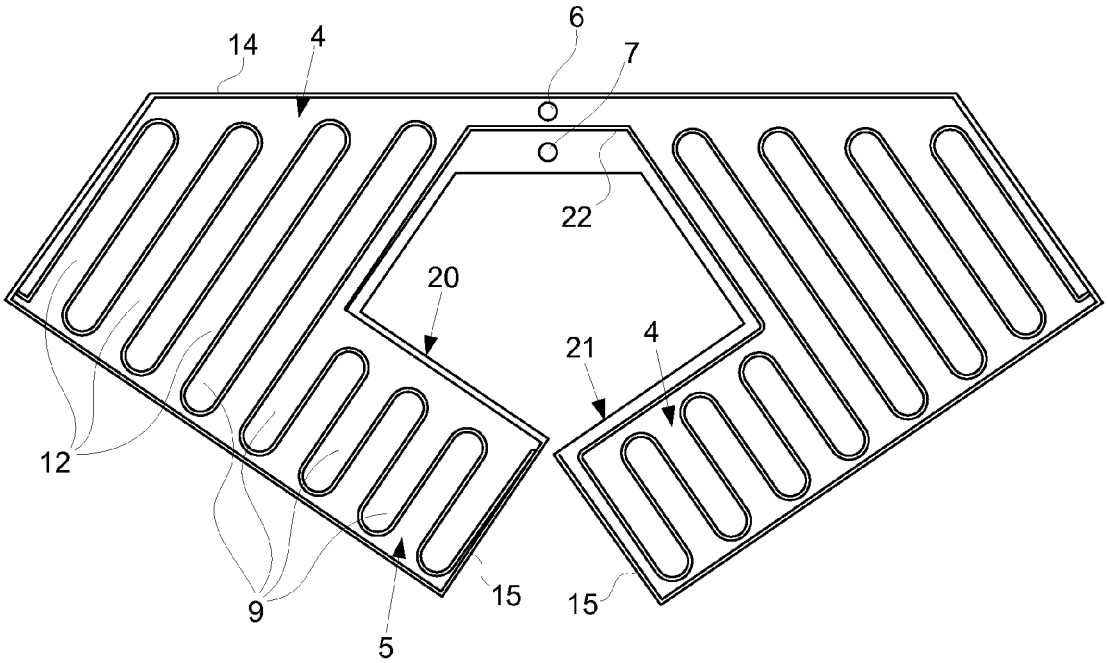
FIG. 3 shows a third embodiment of the invention in a schematic view.

FIG. 3 shows an alternative embodiment of the apparatus in accordance with the invention. The embodiment is arranged in the form of a trouser belt. The first chamber 4 extends substantially in parallel to the upper circumferential edge 14 which is arranged approximately in the belt region during use. The second chamber 5 extends at the bottom edge 15 of the trouser legs which are designated with reference numerals 20, 21. A connecting section 22 produces the pneumatic or hydraulic separation of the individual parts of the second chamber 4, 5. The branch sections 9; 12 extend substantially in parallel or in a meandering fashion in relation to the axis of the trouser legs 20, 21. FIG. 3 shows that respective deviations are possible as a result of the fit. Velcro elements which are not shown in FIG. 3 allow applying the trouser belt before use in a tight manner on the body of the person in order to ensure that the desired therapeutic effect is achieved. In addition, the neoprene trousers are donned in order to ensure that the pressure is applied evenly.

The present invention provides an apparatus which has a simple configuration and which ensures a high therapeutic effect within the terms of increasing blood circulation as a result of alternating pressure loading with respective frequency. The increased blood circulation in that body part ensures that fat burning is maximized in that body part while the person maintains his pulse in the fat burning pulse range.

The invention claimed is:

1. A method for improving cutaneous circulation in a body part of a person by way of a slimming apparatus adapted to be fastened to the body part, the method comprising:

a) providing a slimming apparatus and fastening the slimming apparatus to the body part, the slimming apparatus comprising:

a main body including a fastening element configured to fasten the main body to the body part;

a first chamber having a first nozzle;

a second chamber having a second nozzle;

and a pumping device configured to alternately pressurize and depressurize the first chamber and the second chamber with a fluid;

the pumping device including a first tube having a first connecter detachably connected to the first nozzle, and a second tube having a second connecter detachable connected to the second nozzle;

b) alternately pressurizing and depressurizing the first chamber and the second chamber by repeating the steps of:

aa) pressurizing the first chamber to a first pressure by supplying the first chamber with the fluid;

bb) maintaining the first pressure in the first chamber during a predetermined period;

cc) depressurizing the first chamber by discharging the first chamber in such a manner that the fluid present in the first chamber is at least partially evacuated into the second chamber;

dd) pressurizing the second chamber to a second pressure by supplying the second chamber with the fluid;

ee) maintaining the second pressure in the second chamber during a predetermined period; and ff) depressurizing the second chamber by discharging the second chamber in such a manner that the fluid present in the second chamber is at least partially evacuated into the first chamber.

2. The method of claim 1, which comprises pressurizing at least one of the first chamber or the second chamber to a pressure between 0.3 and 0.6 bar in steps aa) and/or dd).

3. The method of claim 2, which comprises pressurizing at least one of the first chamber or the second chamber to a pressure of 0.5 bar for approximately 5 seconds in steps aa) and/or dd).

4. The method of claim 1, which comprises pressurizing at least one of the first chamber or the second chamber for 2 to 10 seconds in steps aa) and/or dd).

5. The method of claim 1, which comprises maintaining the elevated pressure in the first chamber and/or the second chamber during a period of 6 to 30 seconds in steps bb) and/or ee).

6. The method of claim 5, which comprises maintaining the elevated pressure in the first chamber and/or the second chamber during a period of 15 seconds in steps bb) and/or ee).

* * * * *